US011698235B2

(12) United States Patent
Griffith et al.

(10) Patent No.: US 11,698,235 B2
(45) Date of Patent: Jul. 11, 2023

(54) MAGAZINE RETAINING DEVICE FOR A FIREARM

(71) Applicants: Benjamin Latham Griffith, Salt Lake City, UT (US); Arrius Lee Sorbonne, Salt Lake City, UT (US)

(72) Inventors: Benjamin Latham Griffith, Salt Lake City, UT (US); Arrius Lee Sorbonne, Salt Lake City, UT (US)

( * ) Notice: Subject to any disclaimer, the term of this patent is extended or adjusted under 35 U.S.C. 154(b) by 0 days.

(21) Appl. No.: 17/481,999

(22) Filed: Sep. 22, 2021

(65) Prior Publication Data

US 2023/0003474 A1 Jan. 5, 2023

Related U.S. Application Data

(60) Provisional application No. 63/081,558, filed on Sep. 22, 2020.

(51) Int. Cl.
*F41C 23/12* (2006.01)
*F41A 9/59* (2006.01)
*F41A 3/66* (2006.01)

(52) U.S. Cl.
CPC *F41A 9/59* (2013.01); *F41A 3/66* (2013.01); *F41C 23/12* (2013.01)

(58) Field of Classification Search
CPC ..... F41C 23/12; F41C 23/10; F41A 3/66
USPC ..... 42/71.02, 90, 106
See application file for complete search history.

(56) References Cited

U.S. PATENT DOCUMENTS 1,950,835 A 3/1934 Zajac
2,324,125 A 7/1943 Van Horn
4,100,694 A 7/1978 Musgrave
4,115,943 A 9/1978 Musgrave
4,484,404 A 11/1984 Johnson
(Continued)

FOREIGN PATENT DOCUMENTS

CA 1208057 7/1986

OTHER PUBLICATIONS

Author: BurstReview; Title of publication "CAA Micro Roni—The Ultimate Glock Upgrade?" 1 page, publication date: Dec. 24, 2016; published: Youtube, place of publication: Youtube in USA (https://www.youtube.com/watch?v=4Yf605_41sg).
(Continued)

*Primary Examiner* — Reginald S Tillman, Jr.
(74) *Attorney, Agent, or Firm* — Morris O'Bryant Compagni Cannon, PLLC

(57) ABSTRACT

A dual magazine release system for a firearm has a housing attachable to a firearm. The housing includes first and second magazine holders, the first magazine holder positioned to retain a first magazine to feed ammunition to the firearm and the second magazine holder positioned in front of a trigger of the firearm and configured to retain a spare second magazine. A magazine retaining and release system is coupled to the housing and configured to retain the first magazine in the first magazine holder and to retain the second magazine in the second magazine holder and to selectively release the first magazine or the second magazine independently from one another or to substantially simultaneously release the first and second magazines from the first and second magazine holders, respectively, upon actuation of the magazine retaining and release system by a user.

10 Claims, 20 Drawing Sheets

(56) References Cited

U.S. PATENT DOCUMENTS

| | | | | |
|---|---|---|---|---|
| 4,597,213 | A | 7/1986 | Musgrave | |
| 4,628,627 | A | 12/1986 | Johnson | |
| 4,799,323 | A | 1/1989 | Musgrave | |
| 5,816,683 | A | 10/1998 | Christiansen | |
| 6,698,127 | B2 | 3/2004 | Weber | |
| 6,829,855 | B2 | 12/2004 | Seifert | |
| 7,562,482 | B1 | 7/2009 | Johnson | |
| 8,448,366 | B2 | 5/2013 | Faifer | |
| 9,273,930 | B2 | 3/2016 | Jiminez | |
| 11,193,724 | B1 * | 12/2021 | McCarthy | F41C 23/10 |
| 11,306,986 | B1 * | 4/2022 | Titus | F41A 19/35 |
| 2003/0037474 | A1 | 2/2003 | Weber | |
| 2007/0039226 | A1 | 2/2007 | Stokes | |
| 2007/0137087 | A1 | 6/2007 | Florea | |
| 2007/0180752 | A1 | 8/2007 | Houde-Walter | |
| 2009/0282718 | A1 | 11/2009 | Bartley | |
| 2010/0229448 | A1 | 9/2010 | Houde-Walter | |
| 2010/0263255 | A1 | 10/2010 | Harris | |
| 2011/0030258 | A1 | 2/2011 | Fistikchi | |
| 2011/0047851 | A1 | 3/2011 | Mock | |
| 2011/0107644 | A1 | 5/2011 | Faifer | |
| 2011/0162251 | A1 | 7/2011 | Houde-Walter | |
| 2012/0131829 | A1 | 5/2012 | Fistikchi | |
| 2018/0224239 | A1 * | 8/2018 | Noonan | F41C 23/22 |
| 2019/0249969 | A1 * | 8/2019 | Griffith | F41A 17/38 |

OTHER PUBLICATIONS

Author: sLOVEnc; Title of publication "Micro Roni for Glock 19 9mm" 1 page, publication date: Dec. 6, 2016; published: Youtube, place of publication: Youtube in USA (https://www.youtube.com/watch?v=WHBn5DON4hM).

* cited by examiner

MAGAZINE RETAINING DEVICE FOR A FIREARM

CROSS-REFERENCE TO RELATED APPLICATION

This application claims priority to U.S. Provisional Application No. 63/081,558 filed on Sep. 22, 2020, the entirety of which is incorporated by this reference.

BACKGROUND OF THE INVENTION

Field of the Invention

This invention relates in general to firearms accessories and, in particular, to firearms and firearm accessories that include systems and devices for retaining and releasing primary and spare clips or magazines.

State of the Related Art

Firearms are typically configured with a means for holding a clip or magazine for feeding consecutive rounds of ammunition into the firing chamber for shooting. As used in this disclosure, "firearms" is meant to include both rifles and handguns in the numerous iterations and configurations in which they are made. As also used herein, the term "detachable magazine" refers to a removable ammunition storage and feeding device, commonly referred to as a "clip", that holds several rounds of ammunition and can be selectively attached to and removed from a firearm so as to be reloaded or replaced when the magazine has been depleted of ammunition. It is convenient to have additional ammunition on or about the person in order to replenish or replace the spent clip or magazine that is in use. It is known to provide belts and other wearable devices on which additional clips or magazines may be stored. It is also known to provide an additional clip or magazine on the firearm itself to provide easy and convenient access to a second clip or magazine. While placement of an additional clip or magazine on the firearm enhances access to and placement of the additional clip or magazine in place of the spent clip or magazine, the mechanisms for releasing one or both magazines associated with the firearm are typically independently operated.

In both defensive and sport shooting, the ability to reload a firearm quickly is very important. This has led to devices attachable to the firearm that hold a spare magazine and that can be used to reload the firearm. Each of these prior art devices is attachable to a firearm, such as a handgun, personal defense weapon, or rifle and use a friction fit with flexible locking members and not needing a manually operated release mechanism in order to withdraw the spare magazine. These systems have a number of drawbacks. For example, the magazine can be accidentally removed from the firearm, as it only requires a certain minimum amount of force to overcome the flexible locking members that retain the spare clip or magazine. Additionally, immediately after a user intentionally pulls the magazine from the carrier, the sudden release of force as the clip or magazine is pulled from the device causes the firearm to be immediately pulled in the opposite direction by the hand holding the firearm, forcing the user to bring the two objects into alignment with each other. This movement often causes misalignment of the firearm with the spare clip or magazine, slowing down the reload. Thirdly, the friction and flexible locking member designs of prior art devices are prone to wear, along with wearing down the magazines that are used in conjunction therewith. As the locking members wear, their effectiveness to adequately hold a spare magazine diminishes and can result in more inadvertent dropping of the spare magazine from the device.

Thus, there is a need in the art to provide a dual clip or magazine release system on the firearm that allows for rapid and selective release of one or both clips or magazines from the firearm, that is reliable and significantly decreases the time required to remove and replace a spent clip or magazine of a firearm.

SUMMARY OF THE INVENTION

Accordingly, dual magazine release system for a firearm includes a housing with first and second magazine holders, the first magazine holder positioned to retain a first magazine to feed ammunition to the firearm and the second magazine holder positioned in front of a trigger of the firearm and configured to retain a spare second magazine. A magazine retaining and release system is coupled to the housing and configured to retain the first magazine in the first magazine holder and to retain the second magazine in the second magazine holder and to selectively release the first magazine or the second magazine independently from one another or to substantially simultaneously release the first and second magazines from the first and second magazine holders, respectively, upon actuation of the magazine retaining and release system by a user.

In one embodiment, the magazine retaining and release system comprises at least one magazine retaining member movable between a resting position in which the at least one magazine retaining member engages and retains both of the first and second magazines and a second position in which at least one of the first and second magazines is released from its respective first or second magazine holder.

In another embodiment, the magazine retaining and release system comprises a first release button coupled thereto below and proximate a front side of a trigger guard, the first release button movable between a resting position to a first position in which the first magazine is released and from the first position to a second position in which the second magazine is released.

In yet another embodiment, the magazine retaining and release system further comprises a second release button coupled thereto and positioned proximate to and above a trigger of the firearm, the first release button movable between a resting position to a first position in which the first magazine is released.

In still another embodiment, the magazine retaining and release system comprises a release tab coupled thereto and positioned proximate to and above a trigger of the firearm, the release tab movable between a resting position to a first position in which the first magazine is released.

In another aspect, a magazine retention and release system for a firearm, comprising a mounting system attachable to a firearm and at least one housing to receive and securely retain a spare magazine, having a retention system positioned to lock into a slot in the spare magazine, and a release system positioned to the opposite end of the muzzle, being easily actuated by a user's secondary thumb.

In some embodiments, protective guards are positioned to guard the release from accidental actuation.

In certain embodiments, a protective guard is positioned on the muzzle end of the magazine housing for the purpose of guarding against injury.

In another aspect, a firearm frame comprises a primary body, one or more housings to receive and securely retain a spare magazine, having a retention system positioned to lock into a slot in the spare magazine, and a release system positioned to the opposite end of the muzzle, being easily actuated by a user's secondary thumb.

In yet another embodiment, the retention system of the primary magazine is connected to the release system of the spare magazine housing, allowing a single actuation to release both magazines.

In some embodiments, actuation of the spare magazine release button immediately releases the spare magazine and the primary magazine simultaneously.

In other embodiments, actuation of the spare magazine release button first releases the spare magazine in a first stage, and in a second stage, releases the primary magazine.

In still other embodiments, actuation of the spare magazine release button first releases the primary magazine in a first stage, and in a second stage, releases the spare magazine.

In other embodiments, the magazine release system is integrated into a firearm.

In still other embodiments, the magazine release system is configured to replace a frame of an existing firearm.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings.

DETAILED DESCRIPTION OF THE INVENTION

Figure 1:
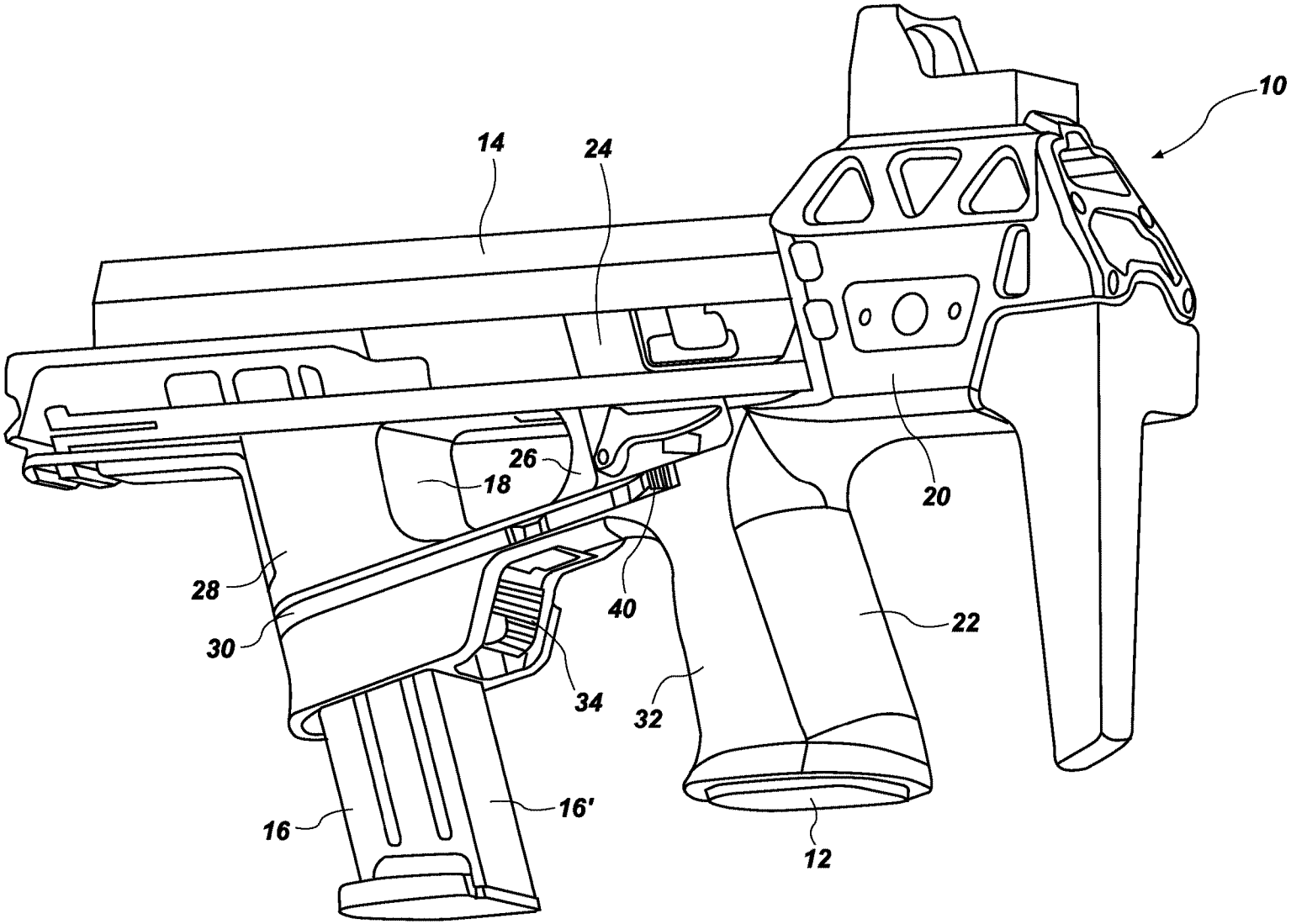
FIG. 1 is a perspective view of a first embodiment of a firearm having a dual magazine retaining and release system in accordance with the present invention.

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for" and the specific function, without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

Figure 2:
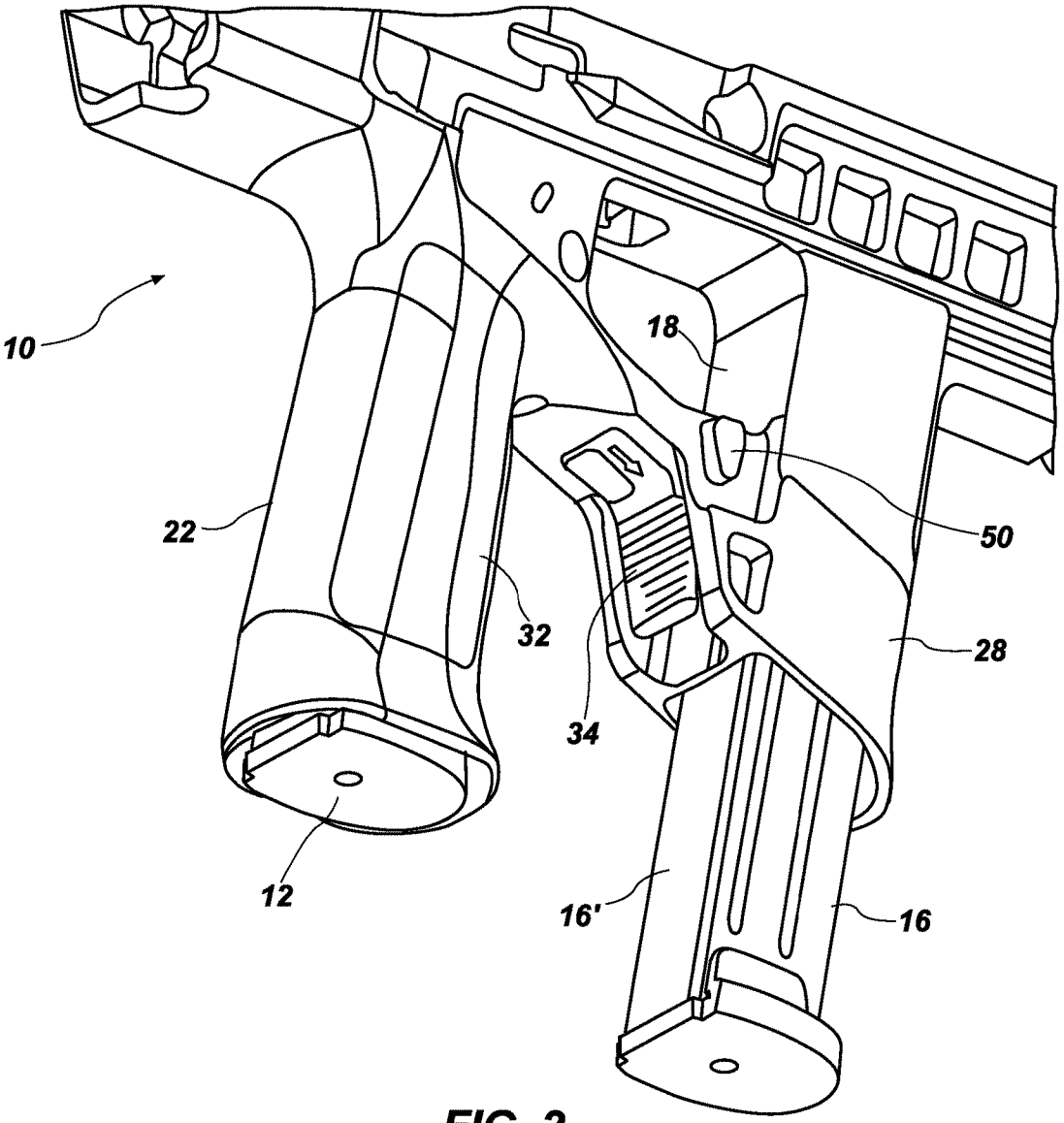
FIG. 2 is another perspective view of the firearm shown in FIG. 1 in accordance with the present invention.

FIGS. 1 and 2 depict a firearm 14 comprising a dual detachable magazine retaining system, generally indicated at 10, for securing a primary detachable magazine 12 relative to the firearm 14 and positioned for immediate deployment of ammunition into the firing chamber of the firearm and for securing a secondary spare detachable magazine 16 forward of the trigger guard 18 of the firearm 14 that can be rapidly released to replace the primary magazine 12 when the primary magazine 12 has been emptied. The dual magazine retaining system 10 includes a housing 20 configured for holding at least the firing components of the firearm (e.g., for a handgun, the firing assembly including the trigger mechanism, barrel, and slide) in an upper portion thereof. In the embodiment shown in FIGS. 1 and 2, the dual detachable magazine retaining system may be configured to replace an existing grip and body (i.e., the frame) of the firearm with the grip portion 22 and body portion 24 of the housing 20, thereby forming a replacement frame for the firearm (i.e., the existing frame of the firearm is replaced with the housing 20). Alternatively, the dual detachable magazine retaining system may be incorporated into the firearm 14 as an integral part thereof with the grip portion 22, body portion 24, barrel, slide, trigger, firing mechanism, etc. assembled together.

Positioned forward of the trigger 26 and forming the distal side of a trigger guard is a secondary magazine holder 28 for retaining the secondary detachable magazine 16. The magazine retaining system 10 of the invention is configured to allow rapid release and removal of each magazine 12 and 16 independently or substantially simultaneously. To accomplish this, a slidable dual release mechanism 30 is slidably coupled to the housing 20 and is disposed between the grip portion 22, extends under the trigger 26 and is slidably coupled to the secondary magazine holder 28.

The slidable dual release mechanism 30 is biased toward a first locking position as shown in FIG. 1 to hold both the primary and secondary magazines 12 and 16 relative to the housing 20. As will be described in further detail herein, the dual release mechanism 30 can be moved relative to the housing 20 in order to independently release either one of the magazines 12 and 16, or to release both magazines 12 and 16 at substantially the same time so that the primary magazine 12 falls from the primary magazine holder portion 32 as the secondary magazine 16 is released while being grasped by the user and subsequently moved to the primary magazine holder 32.

The dual release mechanism 30 can be moved to one of three magazine release positions in a number of ways. First, coupled to the housing 20 below the trigger 26 is a first release button 34. The first release button is configured to be pressed by a thumb of the user while grasping the exposed portion 16' of the secondary magazine 16. The first release mechanism 34 can be pressed approximately half-way of its full range of motion to a first release position in which the secondary magazine 16 only is released from the secondary magazine holder 28. Fully pressing the first release mechanism 34 to nearly its full range of motion will release the primary magazine 12 from the primary magazine holder 32 as well. Thus, for rapid release of both magazines 12 and 16, the first release mechanism 34 is fully pressed from its first resting position toward the secondary magazine holder 28 causing both magazines 12 and 16 to be substantially simultaneously released (i.e., the time it takes to fully depress the first release mechanism 34 typically less than 0.5 seconds).

Alternatively, the dual release mechanism 30 can be directly slid by the user by engaging the thumb magazine release tab 40 that is integrally formed with the dual release mechanism 30. The thumb release tab 40 is positioned proximate a top portion of the grip portion 22 proximate where the right thumb of the user would reside when gripping the grip portion 22. By sliding the dual release mechanism 30 toward the front end of the secondary magazine holder 28 with a thumb, the user can selectively release the primary magazine 12 without releasing the secondary magazine 16. That is, by sliding the dual release mechanism 30 toward the front end of the secondary magazine holder 28, the user releases the first magazine 12 by sliding the dual release mechanism 30 until the first magazine 12 is released.

Finally, as shown in FIG. 2, the primary magazine 12 can also be released independently of the secondary magazine 16 by pressing the second release mechanism 50 with the right index finger of the user when gripping the grip portion 22. As will be described in more detail, the second release mechanism is coupled to the dual release mechanism 30 in a manner by which the primary magazine 16 is released from the primary magazine holder 28 without releasing the secondary magazine 16 from the secondary magazine holder 28.

Figure 3:
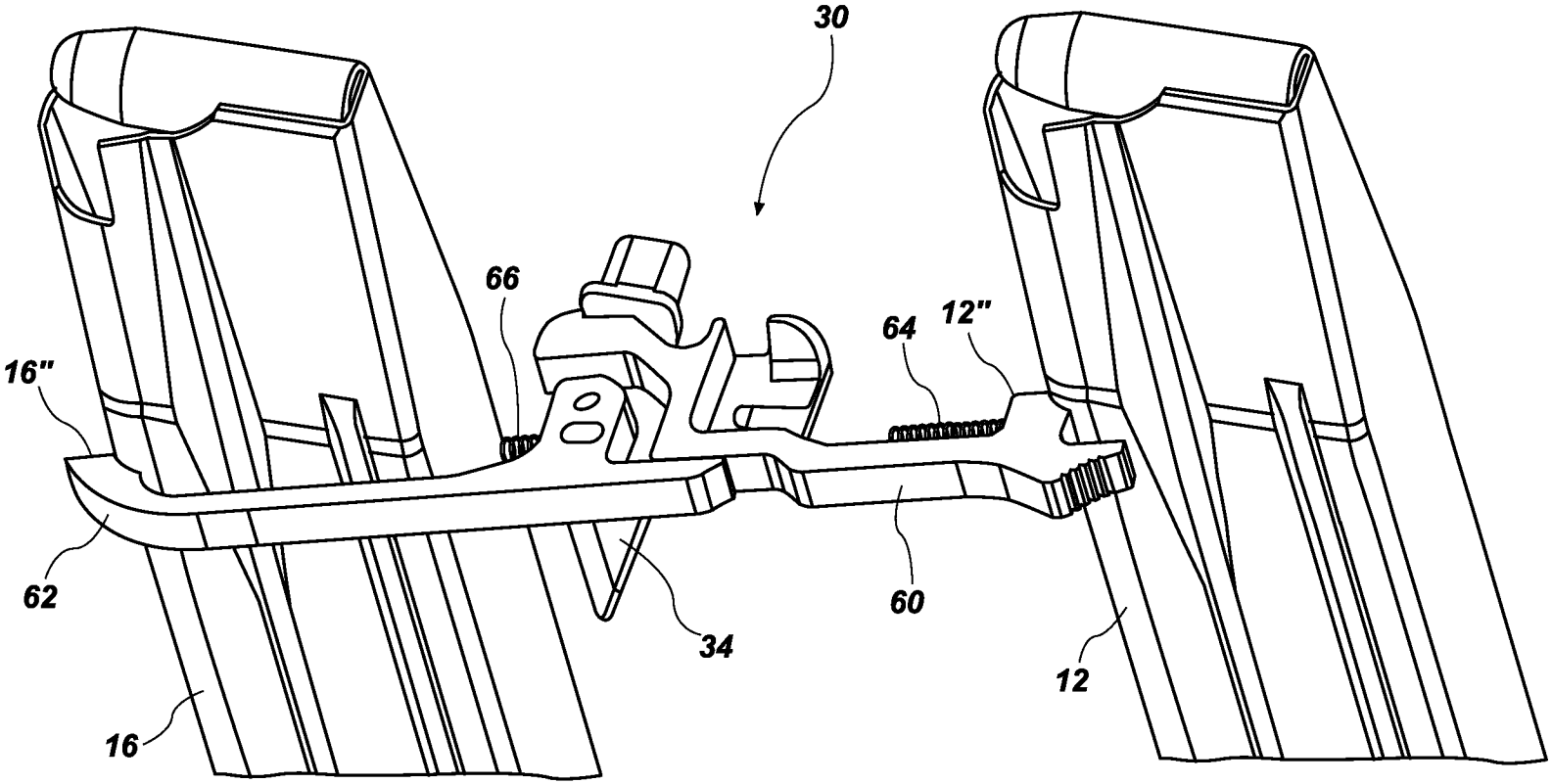
FIG. 3 is a perspective view of a magazine retaining and release mechanism in a first position in accordance with the present invention.

Referring now to FIG. 3, there is illustrated components of the dual release mechanism 30 when positioned within the housing 20 (not shown) and retaining two conventional magazines, a primary magazine 12 and a secondary magazine 16, each containing ammunition. Such conventional magazines 12 and 16 are each configured with a retaining notch 12" and 16" respectively. The dual release mechanism 30 engages with the two retaining notches 12" and 16" to hold the magazines 12 and 16 relative to the dual release mechanism 30 and thus the housing 20 (not shown).

The dual release mechanism 30 is comprised of a first release member 60 and a second release member 62. In the resting position, the first release member 60 engages the notch 12" of the primary magazine 12 and the second release member 62 engages the second notch 16" of the secondary magazine 16. The first release member 60 is biased toward and into the first notch 12" with spring 64. The second release mechanism 62 operates independently of the first release mechanism 60 and is biased with spring 66 relative to the secondary magazine 16 so that the distal end of the second release mechanism 62 engages with the notch 16" of the secondary magazine 16.

Figure 4:
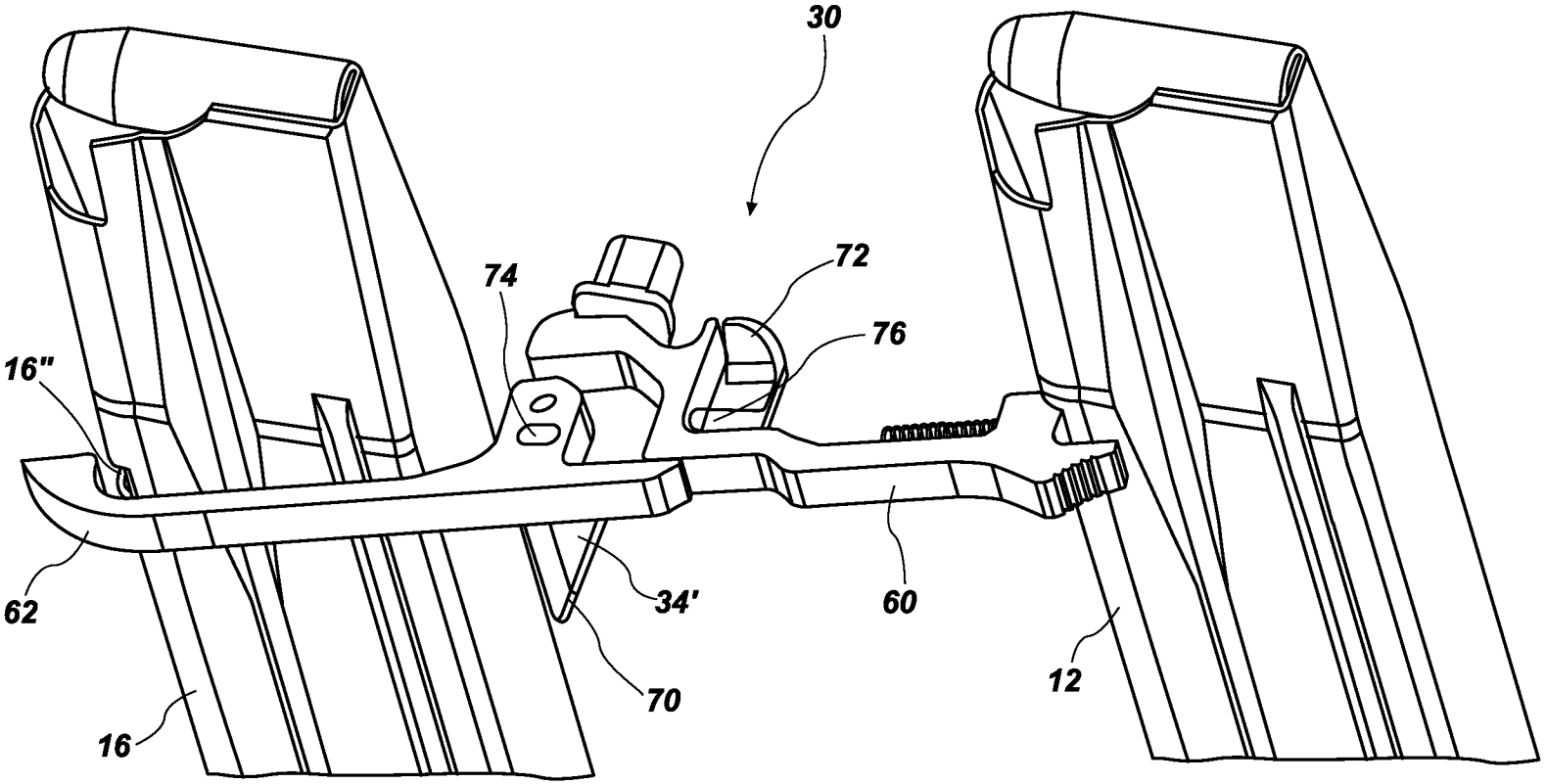
FIG. 4 is a perspective view of the magazine retaining and release mechanism shown in FIG. 3 in a second position.

As previously discussed, the dual release mechanism 30 is configured to release one or both of the magazines 12 and 16 in a number of ways. As shown in FIG. 4, as the first release button 34' is partially depressed toward the secondary magazine 16 as shown, the second release member 62 disengages from the notch 16" of the secondary magazine 16 to release the secondary magazine 16. To do so, the first release button is configured to slide within the housing from a first resting position to first release position as shown to a fully depressed position as further herein described. The first release button 34' includes a first portion 70 for pressing by a user that downwardly depends from a release portion 72. The release portion 72 is coupled to the second release member 62 with an upwardly extending tab 74 to cause direct translational movement of the second release member 62 when the first portion is pressed. The release portion 72 includes a second set of tabs 76 that can abut against and engage the first release member 60 when fully depressed to also then move the first release mechanism 60 as will be further described. Thus, as sown in FIG. 4, when the first release mechanism 34 is partially depressed, the secondary magazine 16 is released without release of the primary magazine 12.

Figure 5:
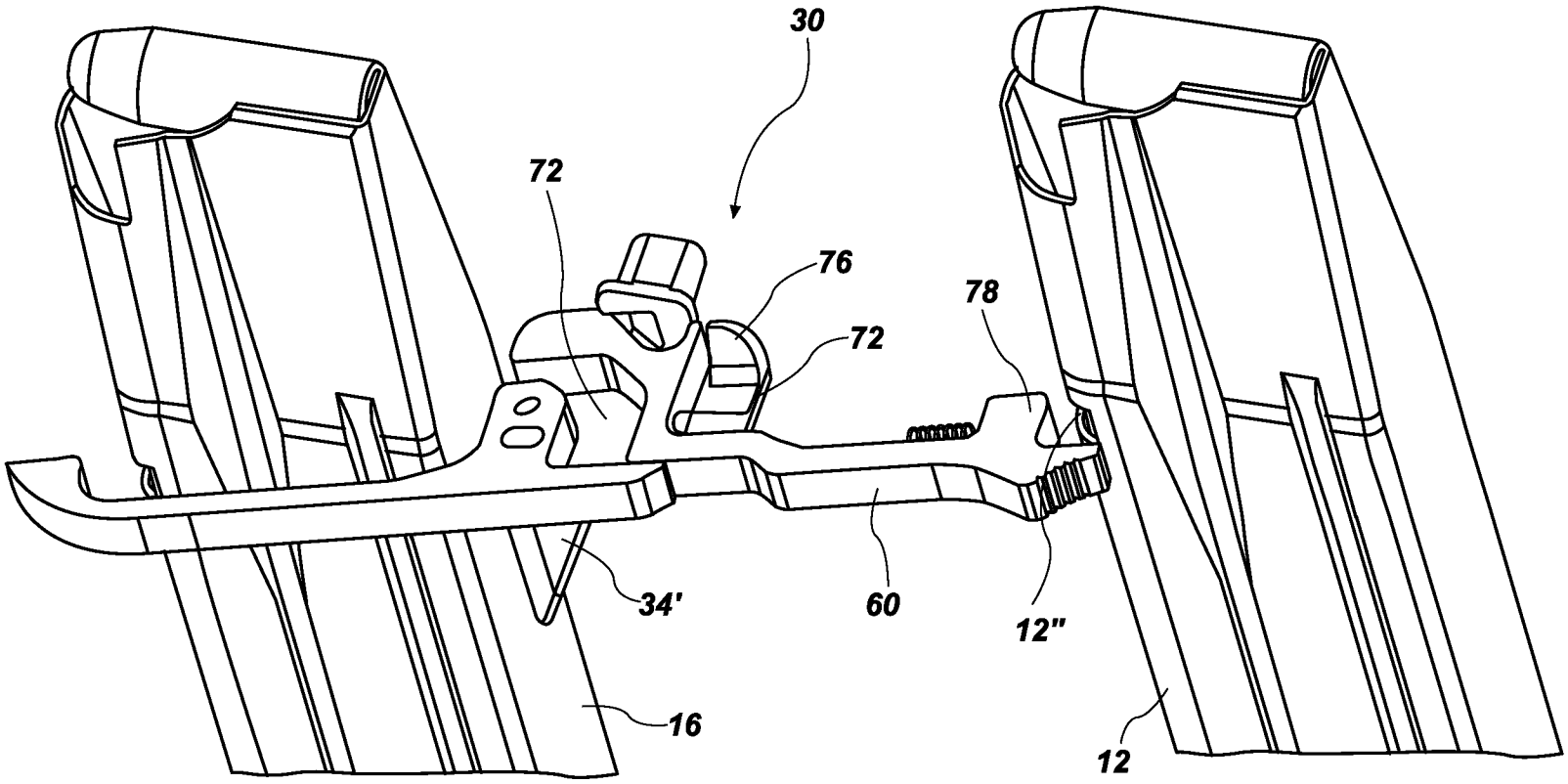
FIG. 5 is a perspective view of the magazine retaining and release mechanism shown in FIG. 3 in a third position.

As shown in FIG. 5, as the first release button 34' of the first release mechanism 30 is continued to be depressed from the first release position to a fully depressed second release position, the release portion 72 slides under the distal end portion of the first release member 60 until the tabs 76 of the release portion 72 engage a surface of the first release member 60 and subsequently pull the magazine engagement portion 78 of the first release mechanism 60 from the notch 12" of the primary magazine 12. This releases the primary magazine 12 with the secondary magazine 16 having already been released.

Figure 6:
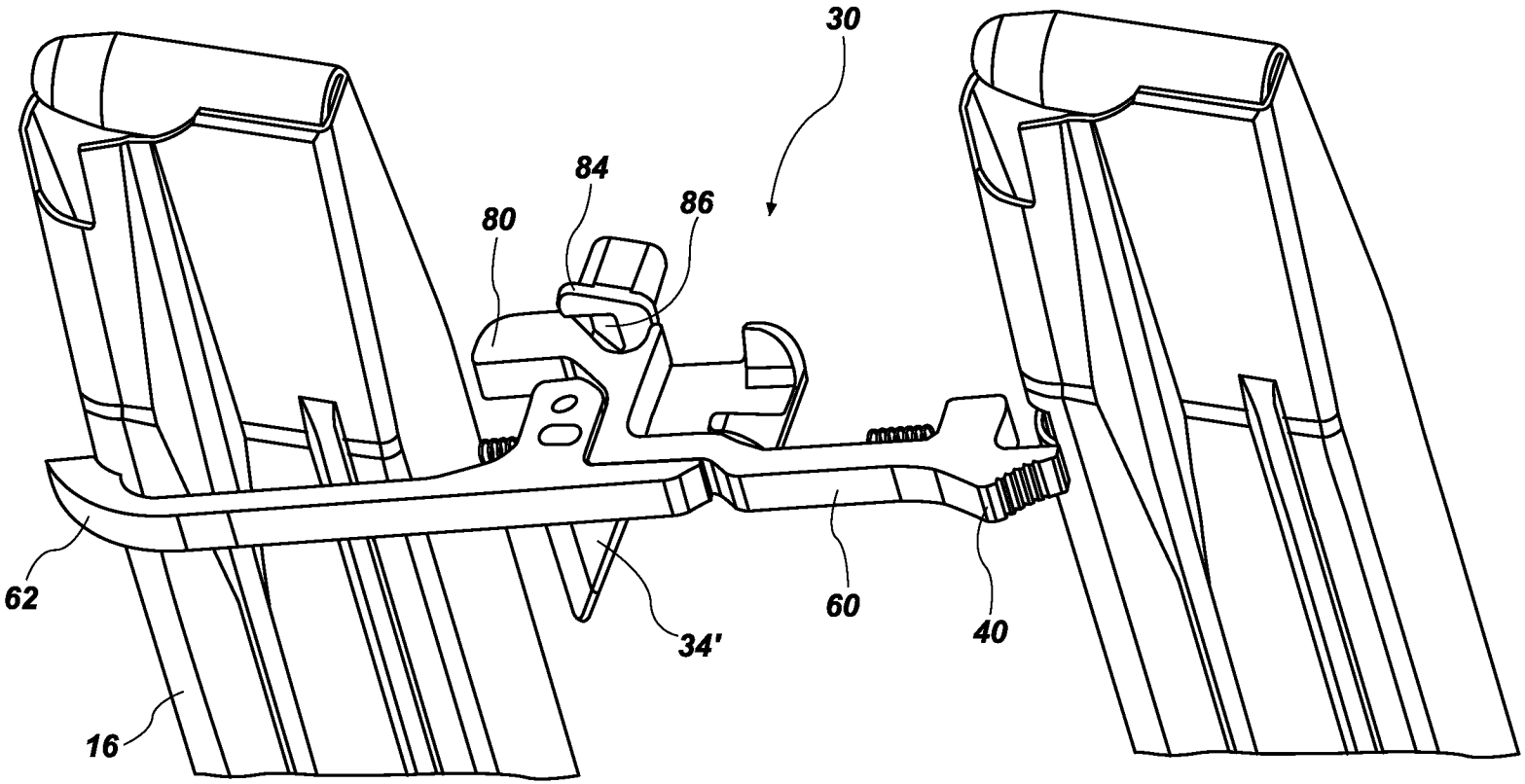
FIG. 6 is a perspective view of the magazine retaining and release mechanism shown in FIG. 3 in a fourth position.

Referring now to FIG. 6, the first release member 60 of the dual release mechanism 30 is moved forward by engaging the thumb tab 40 and sliding the first release member 60 toward the secondary magazine 16. This can be done without moving the second release member 62 thus retaining the secondary magazine 16 relative to the dual release mechanism 30. That is, the first release button 34' and the second release member 62 stay in place and engaged with the secondary magazine 16 to hold it relative to the housing 20 (not shown). The first release member 60 includes an abutment or stop portion 80 that engages with the housing 20 (not shown) to prevent the first release member 60 from being pushed with the thumb tab 40 past a point where the second release member 62 could be moved to release the secondary magazine 16.

Figure 7:
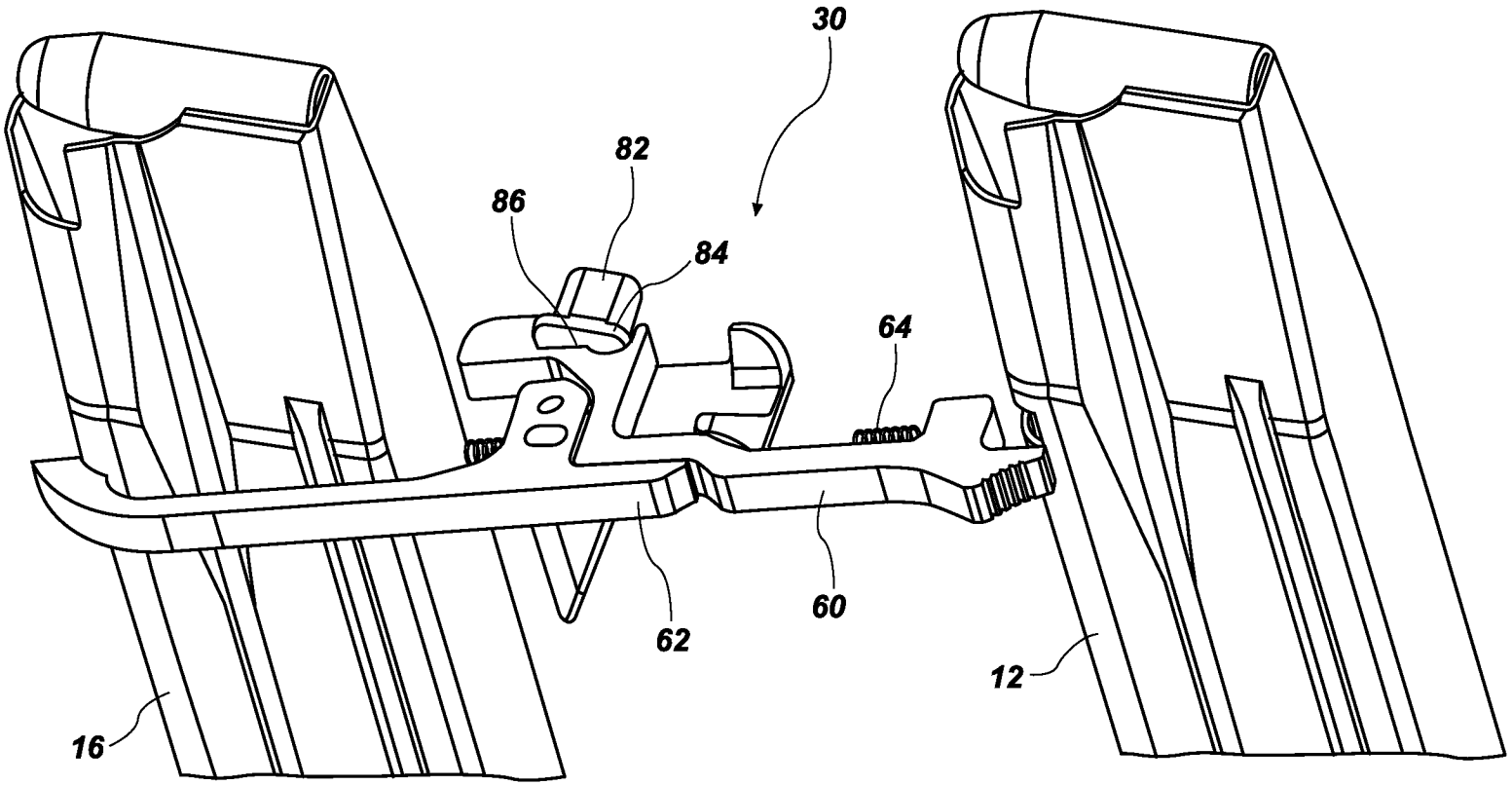
FIG. 7 is a perspective view of the magazine retaining and release mechanism shown in FIG. 3 in a fifth position.

As shown in FIGS. 6 and 7, the primary magazine 12 can also be released by pressing the second release button 82. The second release button 82 is in turn outwardly biased by the spring 64 as the first release member 60 is forced toward the primary magazine 12 As shown in FIG. 7, the first release member includes an angled surface 84, which may be between about 30 to 60 degrees. The second release button 82 includes a matching angled surface 86 that engages the angled surface 84 when the first release member 60 is in a resting position. As shown in FIG. 7, Aa the second release button 82 is inwardly pressed, the engagement of the angled surface 86 with the angled surface 84 causes the first release member 60 to slide toward the secondary magazine 16 to thereby release the primary magazine 12. Further pushing of the second release button 82, however, cannot cause forward movement of the second release member 62 to release the secondary magazine 16. Thus, pressing the second release button 82 can only cause release of the primary magazine 12.

Figure 8:
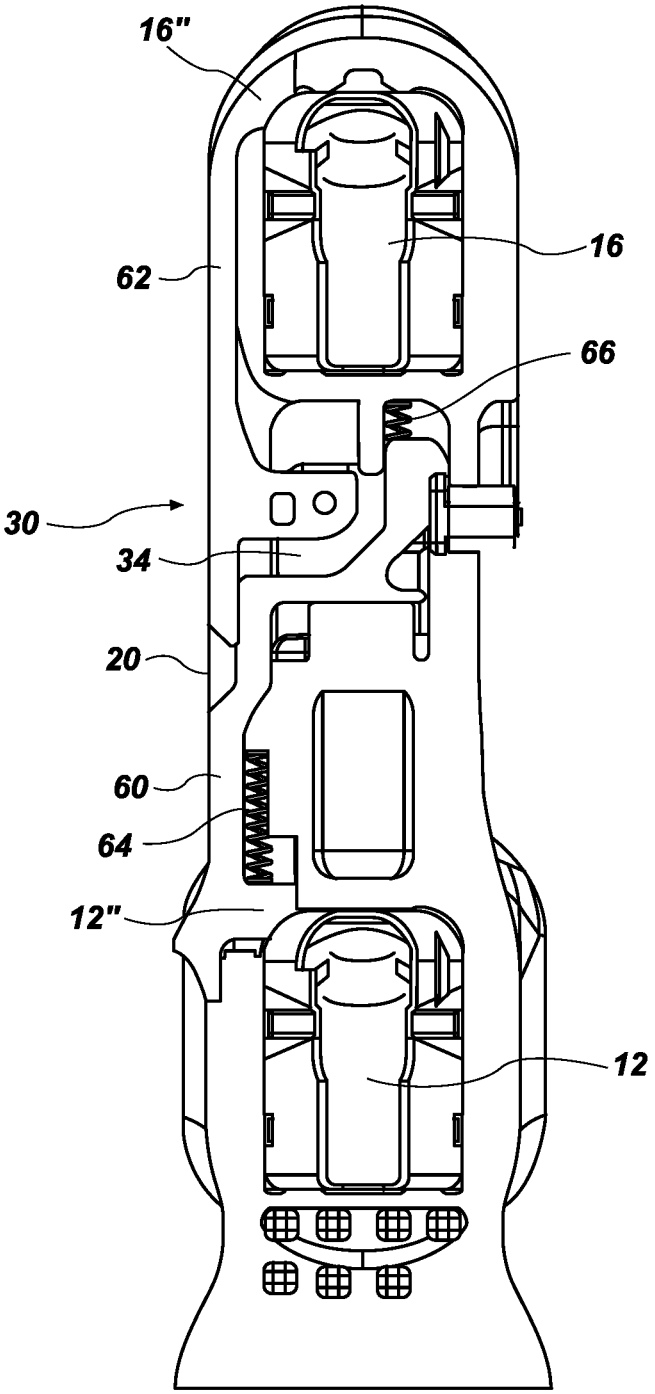
FIG. 8 is a top cross-sectional view of the magazine retaining and release mechanism in a first position in accordance with the present invention.

Referring now to FIG. 8, there is illustrated a cross-sectional top view of the components of the dual release mechanism 30 when positioned within the housing 20 and retaining two conventional magazines, a primary magazine 12 and a secondary magazine 16, each containing ammunition. Such conventional magazines 12 and 16 are each configured with a retaining notch 12" and 16" respectively. The dual release mechanism 30 engages with the two retaining notches 12" and 16" to hold the magazines 12 and 16 relative to the dual release mechanism 30 and thus the housing 20.

The dual release mechanism 30 is comprised of a first release member 60 and a second release member 62. In the resting position, the first release member 60 engages the notch 12" of the primary magazine 12 and the second release member 62 engages the second notch 16" of the secondary magazine 16. The first release member 60 is biased toward and into the first notch 12" with spring 64. The second release mechanism 62 operates independently of the first release mechanism 60 and is biased with spring 66 relative to the secondary magazine 16 so that the distal end of the second release mechanism 62 engages with the notch 16" of the secondary magazine 16.

Figure 9:
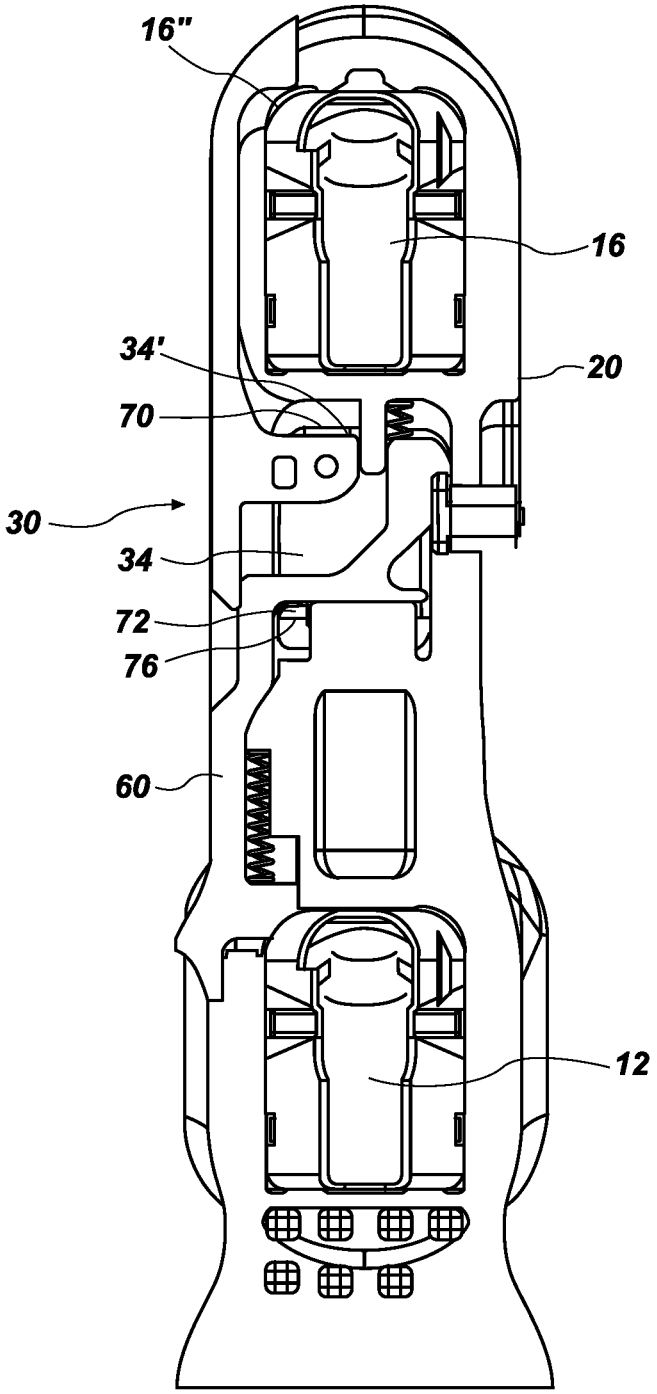
FIG. 9 is a top cross-sectional view of the magazine retaining and release mechanism shown in FIG. 7 in a second position.

As previously discussed, the dual release mechanism 30 is configured to release one or both of the magazines 12 and 16 in a number of ways. As shown in FIG. 9, as the first release button 34' is partially depressed toward the secondary magazine 16 as shown, the second release member 62 disengages from the notch 16" of the secondary magazine 16 to release the secondary magazine 16. To do so, the first release button is configured to slide within the housing from a first resting position to first release position as shown to a fully depressed position as further herein described. The first release button 34' includes a first portion 70 for pressing by a user that downwardly depends from a release portion 72. The release portion 72 is coupled to the second release member 62 with an upwardly extending tab 74 to cause direct translational movement of the second release member 62 when the first portion is pressed. The release portion 72 includes a second set of tabs 76 that can abut against and engage the first release member 60 when fully depressed to also then move the first release mechanism 60 as will be further described. Thus, as sown in FIG. 9, when the first release mechanism 34 is partially depressed, the secondary magazine 16 is released without release of the primary magazine 12.

Figure 10:
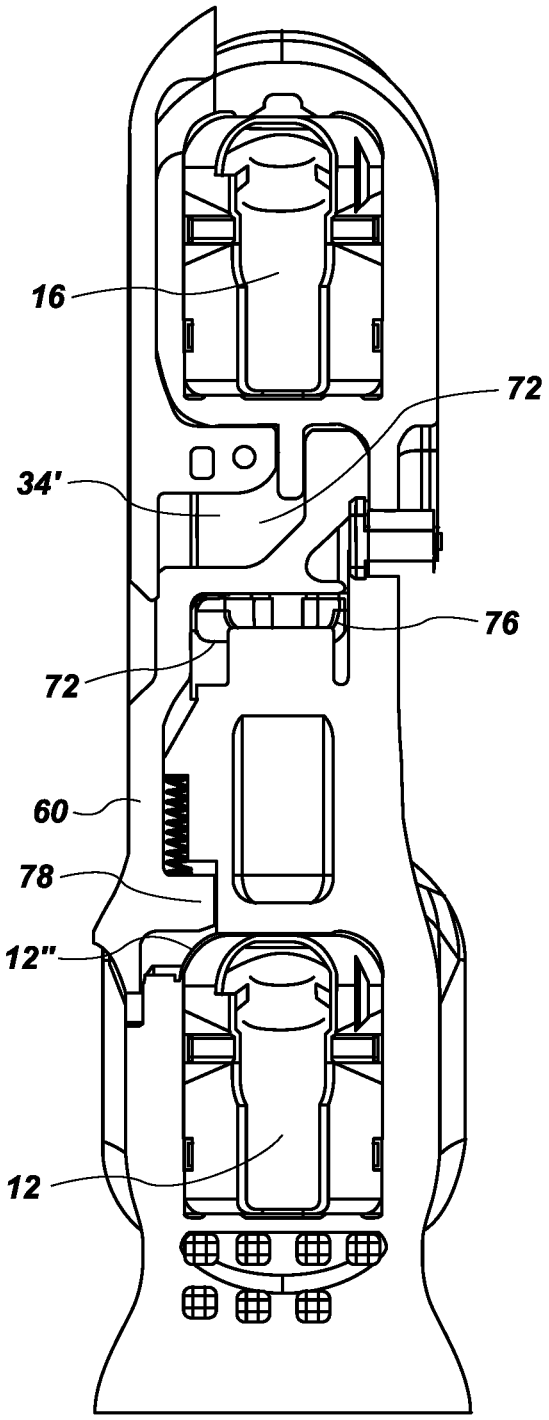
FIG. 10 is a top cross-sectional view of the magazine retaining and release mechanism shown in FIG. 7 in a third position.

As shown in FIG. 10, as the first release button 34' of the first release mechanism 30 is continued to be depressed from the first release position to a fully depressed second release position, the release portion 72 slides under the distal end portion of the first release member 60 until the tabs 76 of the release portion 72 engage a surface of the first release member 60 and subsequently pull the magazine engagement portion 78 of the first release mechanism 60 from the notch 12" of the primary magazine 12. This releases the primary magazine 12 with the secondary magazine 16 having already been released.

Figure 11:
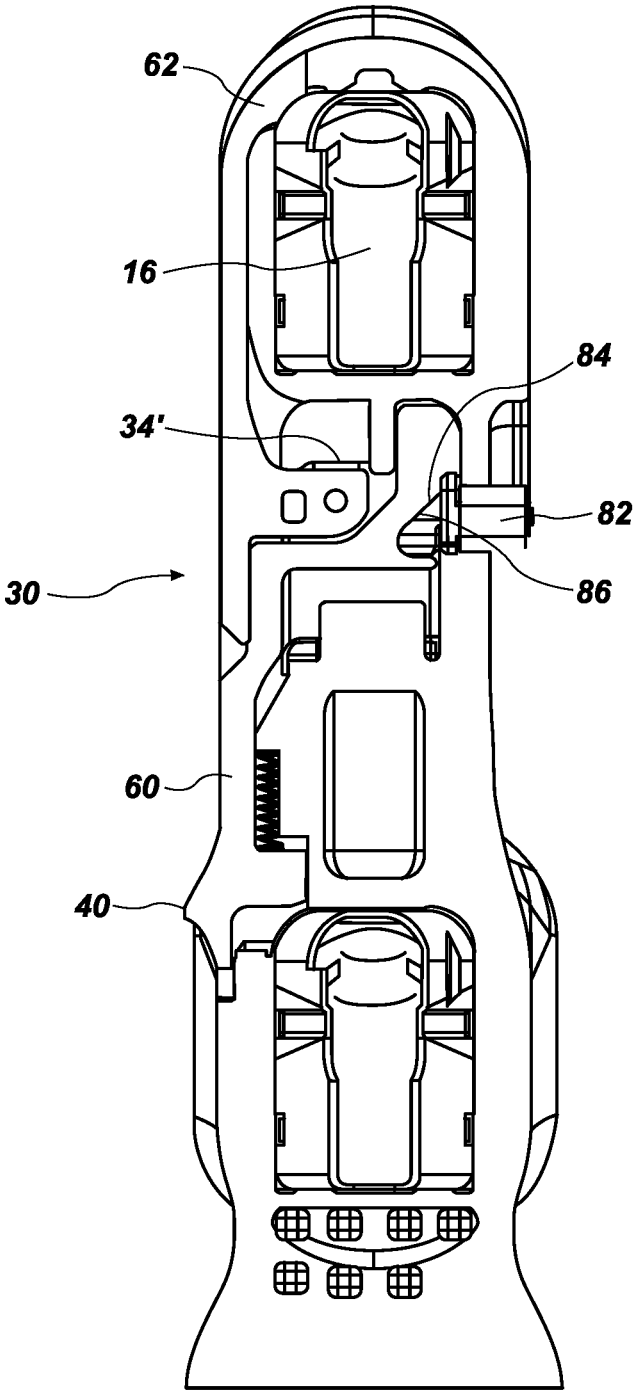
FIG. 11 is a top cross-sectional view of the magazine retaining and release mechanism shown in FIG. 7 in a fourth position.

Referring now to FIG. 11, the first release member 60 of the dual release mechanism 30 is moved forward by engaging the thumb tab 40 and sliding the first release member 60 toward the secondary magazine 16. This can be done without moving the second release member 62 thus retaining the secondary magazine 16 relative to the dual release mechanism 30. That is, the first release button 34' and the second release member 62 stay in place and engaged with the secondary magazine 16 to hold it relative to the housing 20. The first release member 60 includes an abutment or stop portion 80 that engages with the housing 20 to prevent the first release member 60 from being pushed with the thumb tab 40 past a point where the second release member 62 could be moved to release the secondary magazine 16.

Figure 12:
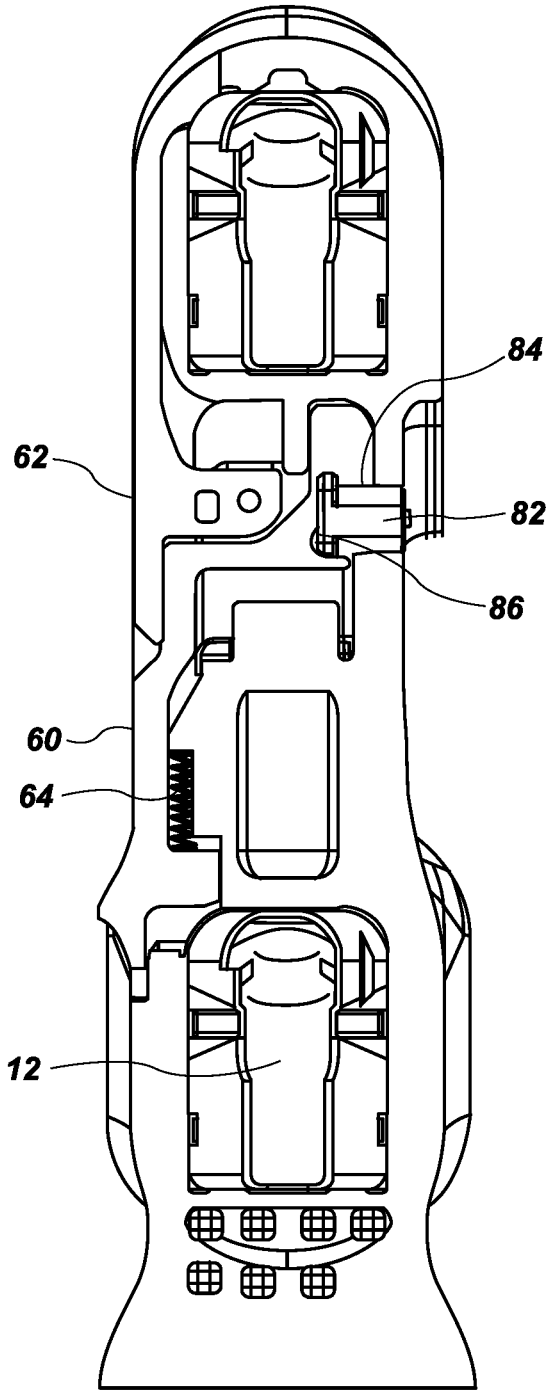
FIG. 12 is a top cross-sectional view of the magazine retaining and release mechanism shown in FIG. 7 in a fifth position.

As shown in FIGS. 11 and 12, the primary magazine 12 can also be released by pressing the second release button 82. The second release button 82 is in turn outwardly biased by the spring 64 as the first release member 60 is forced toward the primary magazine 12. As shown in FIG. 12, the first release member includes an angled surface 84, which may be between about 30 to 60 degrees. The second release button 82 includes a matching angled surface 86 that engages the angled surface 84 when the first release member 60 is in a resting position. As shown in FIG. 12, as the second release button 82 is inwardly pressed, the engagement of the angled surface 86 with the angled surface 84 causes the first release member 60 to slide toward the secondary magazine 16 to thereby release the primary magazine 12. Further pushing of the second release button 82, however, cannot cause forward movement of the second release member 62 to release the secondary magazine 16. Thus, pressing the second release button 82 can only cause release of the primary magazine 12.

Those of skill in the art will appreciate that the dual magazine release system of the present invention could be configured with various levers, push slides (similar to traditional magazine release systems) to accomplish the same result as the present invention including simultaneous release of both magazines, one after the other in any order or the like. In addition, while the present invention has been shown to be part of a housing that is attached to or coupled to a firearm or parts of a firearm, the dual magazine release system of the present could be incorporated into the frame of the firearm itself. Thus, other means of accomplishing the same result could be accomplished by various mechanisms that one of skill in the art may appreciate upon review of the present invention and such variants are intended to be part of the claimed invention.

Figures 13A, 13B, 13C:
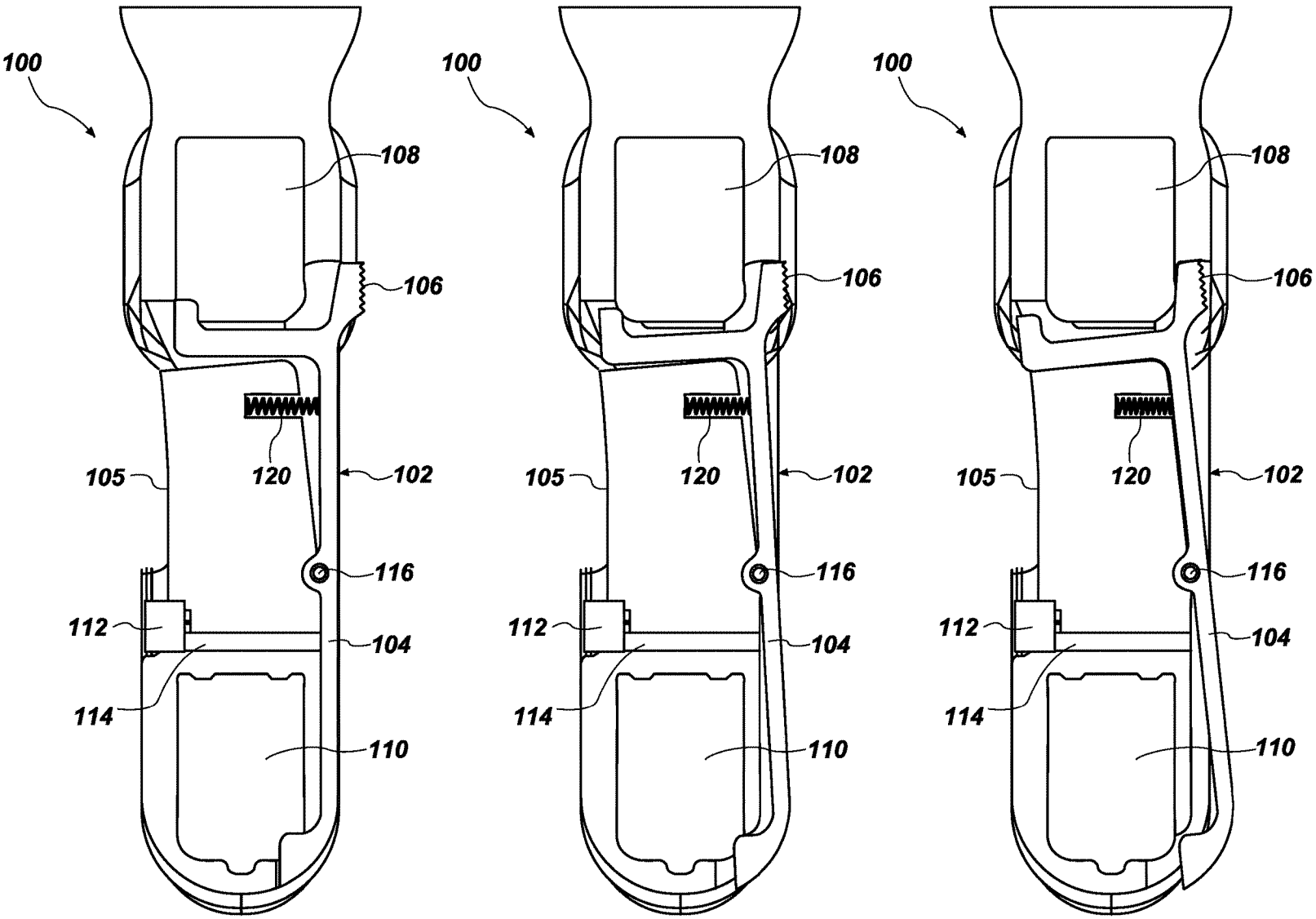
FIGS. 13A-13C are top cross-sectional views of a second embodiment of a dual magazine retaining and release system in accordance with the present invention.

For example, as shown in FIGS. 13A-13C, a dual magazine release system, generally indicated at 100, is illustrated. In this embodiment, the release mechanism 102 is comprised of a single integrated lever 104 that is pivotally coupled to the housing 105 proximate a midpoint thereof. The proximal end of the lever 104 is provided with a thumb tab 106 that can be inwardly depressed to release one or both magazines 108 and 110 depending on the amount of depressing toward the housing 105.

Secondarily, the release mechanism 102 can be pivoted to release one or both magazines 108 and 110 with an index finger release button 112 positioned on the opposite side of the housing 105. Pressing the release button 112 from a resting position to a first release position will release the first magazine 108. Fully depressing the release button 112 will release both magazines 108 and 110. The release button 112 when pressed forces a push rod 114 through the housing 105. The distal end of the push rod 114 engages the lever 104 on the distal side of the pivot 116 to thereby pivot the lever 104 away from engagement with the magazines 108 and 110. The lever 104 is biased into a closed or retaining position with the spring 120.

Figure 14:
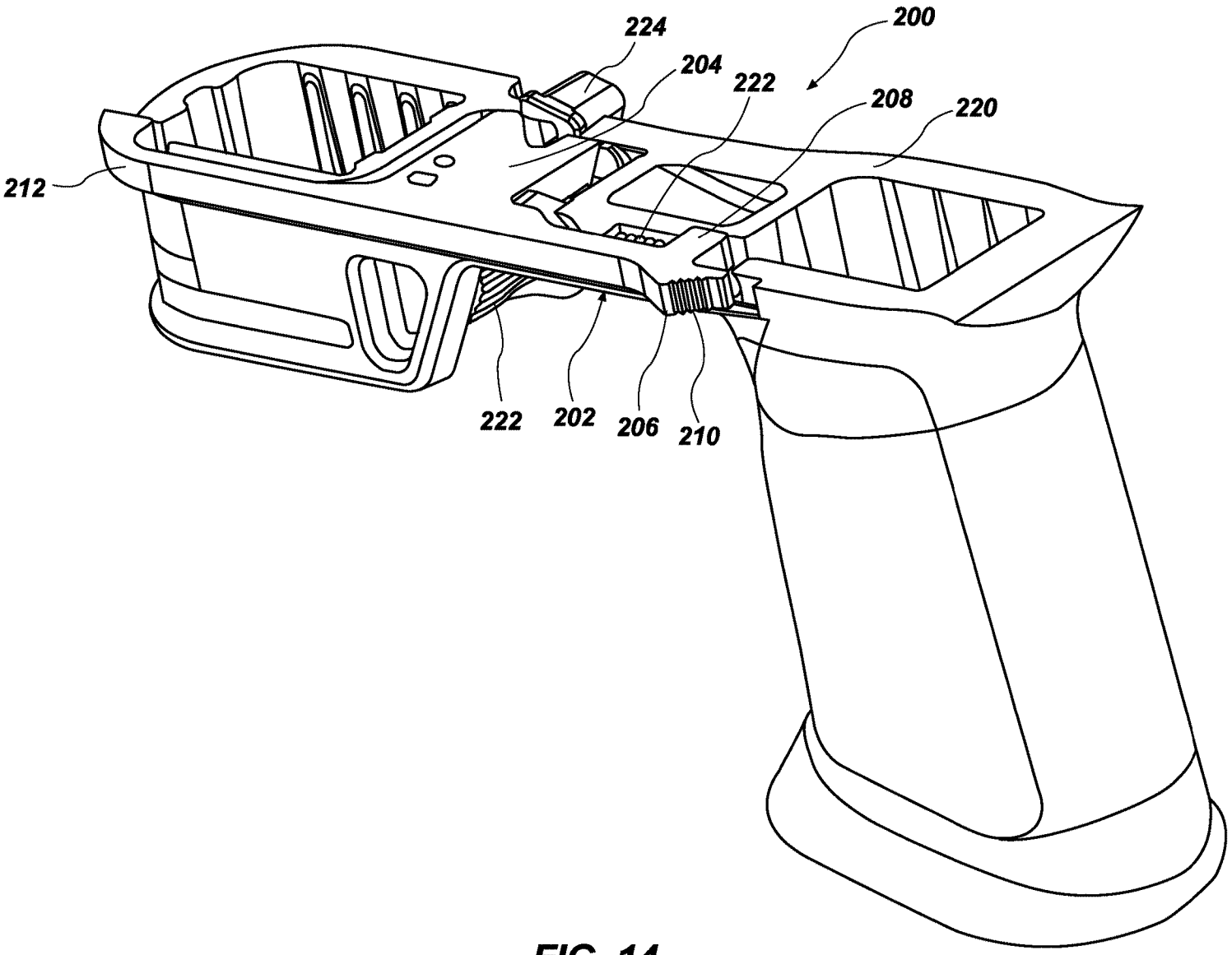
FIG. 14 is a perspective view of a third embodiment of a dual magazine retaining and release system in accordance with the present invention.

Similarly, as shown in FIG. 14, another embodiment of a dual magazine release system, generally indicated at 200, includes a release mechanism 202 comprising an integrated release member 204. The release member 204 has a proximal end portion 206 that comprises a first magazine retaining portion 208 and a thumb tab 210 for sliding the release member 204 toward its distal end 212. The release member 204 is biased relative to the housing 220 with spring 222. Sliding the release member 204 from a first resting position, in which both magazines (not shown) are retained relative to the housing 220, to a second position can simultaneously release both magazines. This can be accomplished by moving the thumb tab 206 toward the distal end 212 or by pressing the thumb button 222, which is coupled to the release member 204, toward the distal end 212. Likewise, the side index finger button 224 can be depressed to force the release member 204 toward the distal end 212 until both magazines are released.

Figure 15C:
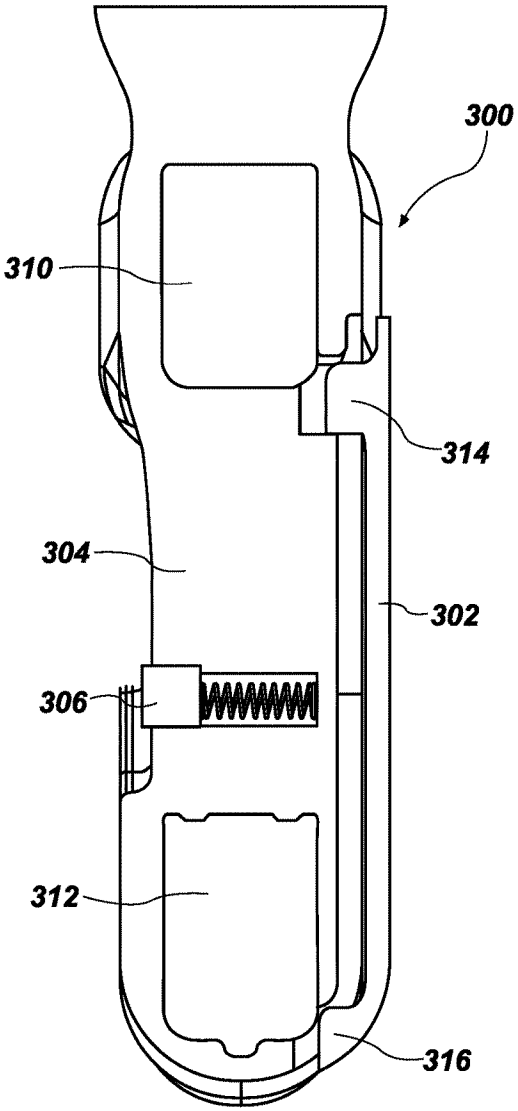
FIGS. 15A-15C are top cross-sectional views of a fourth embodiment of a dual magazine retaining and release system in accordance with the present invention.
Figure 15B:
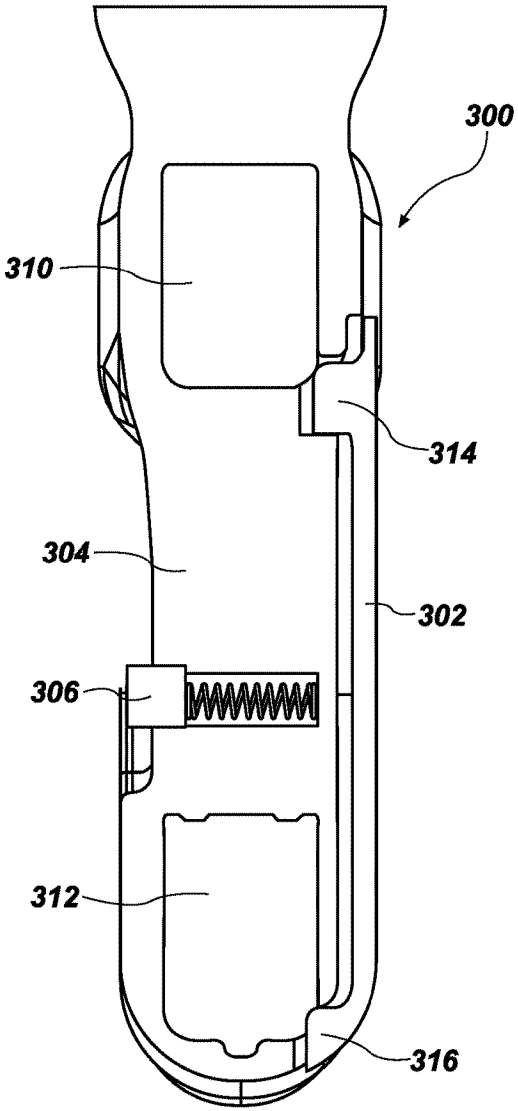
Figure 15A:
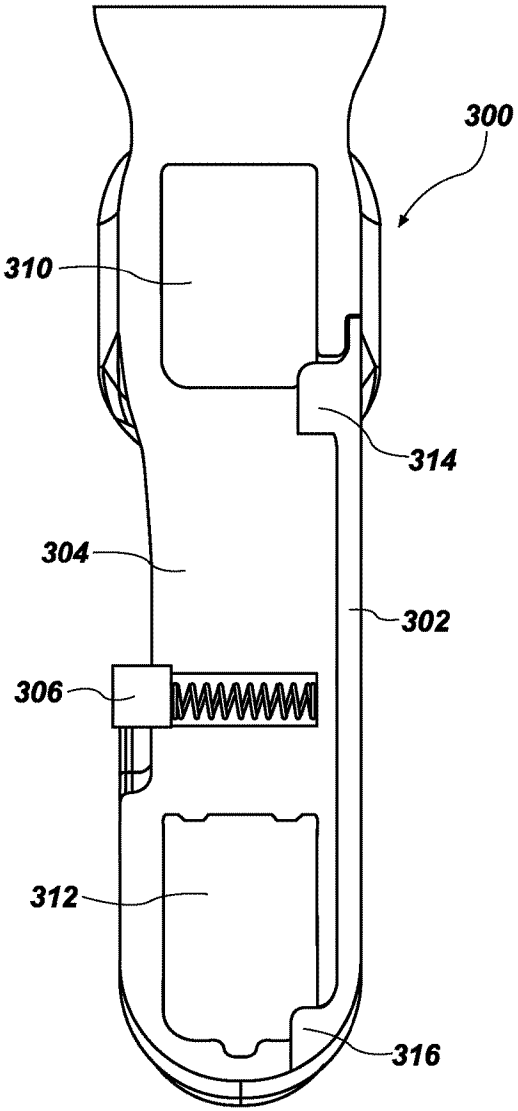

As shown in FIGS. 15A-15C, another embodiment of a dual magazine release system, generally indicated at 300, is illustrated. Here, the dual magazine release system 300 includes an integrated release member 302 that is configured to laterally translate relative to the housing 304 by pressing an index finger release button 306. The release button 306 is outwardly biased to a resting position in which the release member 302 engages both magazines 310 and 312 to retain them relative to the housing 304. Pressing the release button 306 toward the housing 304 to a first release position causes the first retaining tab 314, which holds the first magazine 310, to release the first magazine 310. Fully pressing the release button 306 toward the housing 304 to a second release position causes the second retaining tab 316 to release the second magazine 312. In all cases, for insertion of a magazine into the devices as herein described, the magazines themselves have tapered ends to slide past the respective retaining members until the retaining notch in the magazine is reached, at which point the retaining members snap into engagement with the notch and thus the magazine.

Figure 16:
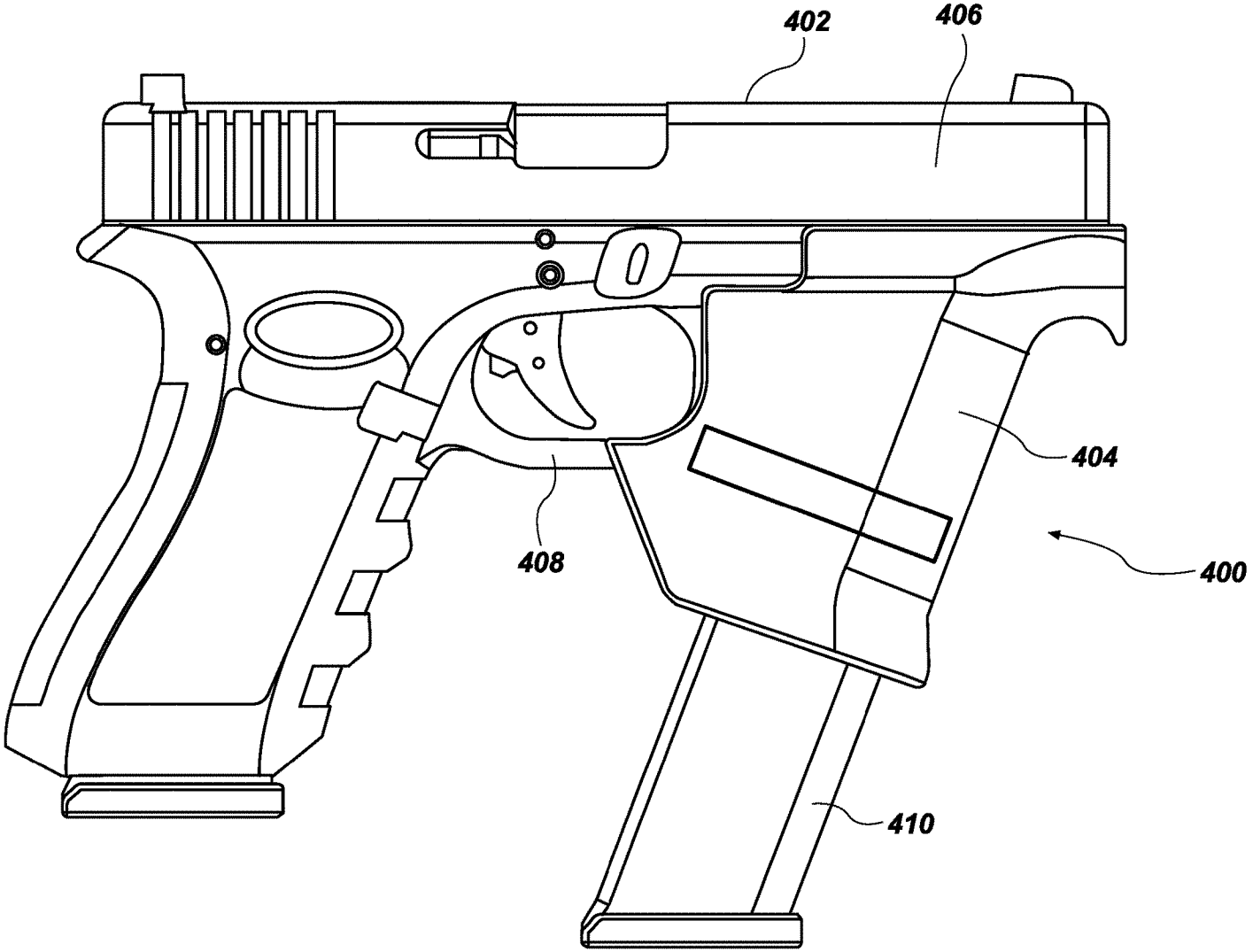
FIG. 16 is a side view of an embodiment of a magazine retaining and release system in accordance with the present invention.

Finally, as shown in FIGS. 16-20, the release system of the present invention may be configured to provide a single spare magazine release system for a firearm. For example, as shown in FIG. 16, a spare magazine release system, generally indicated at 400, is attached to a handgun 402. The magazine release system 400 includes a housing 404 that is configured to be coupled to the distal end portion of the barrel 406 of the handgun 402 and depend downwardly therefrom. The housing 404 is configured to abut against the distal end portion of the trigger guard 408 of the handgun 402 so as to provide additional lateral stability to the housing 404 relative to the handgun 402. The housing 404 is configured to hold and releasably retain a single spare magazine 410.

Figure 17:
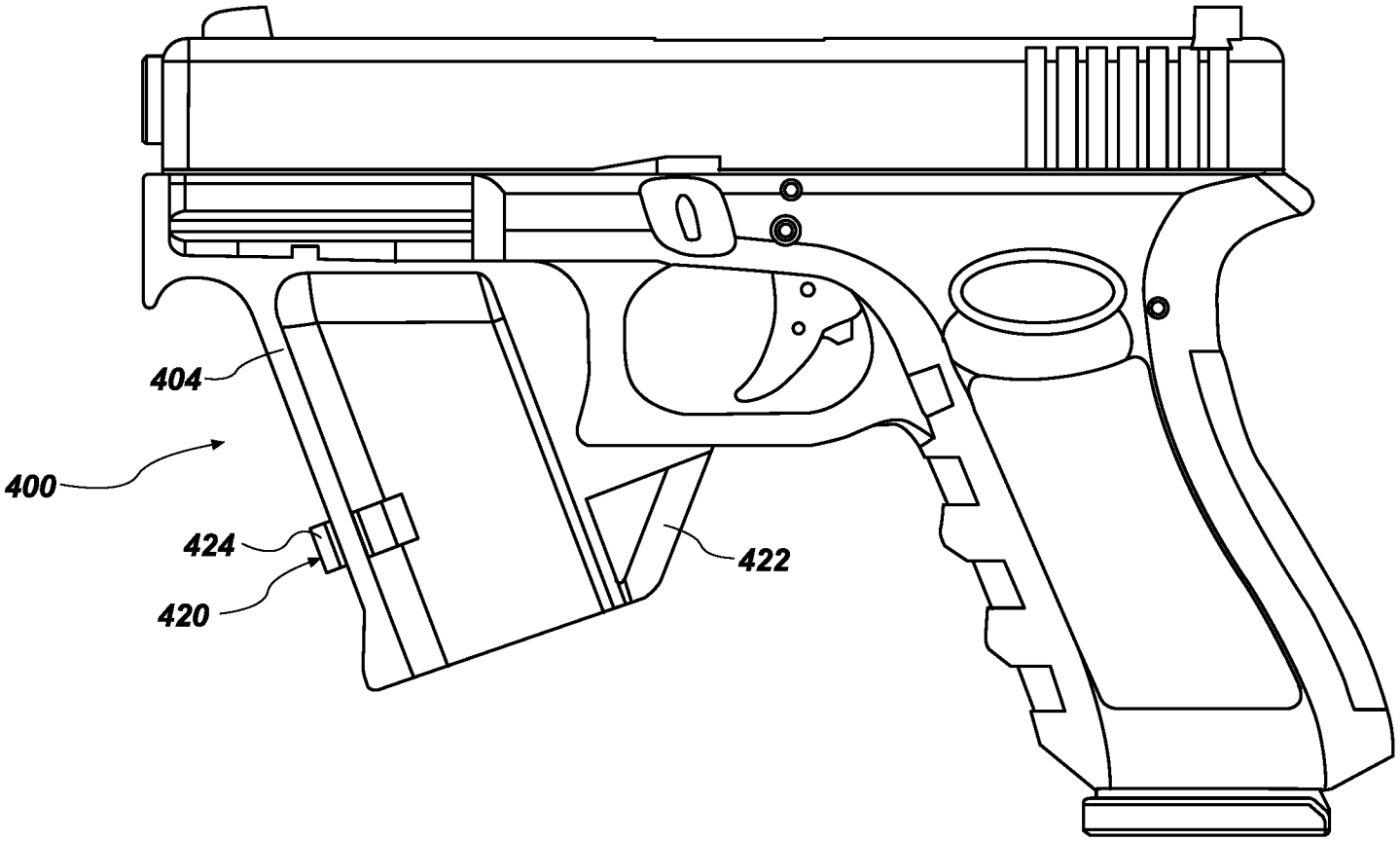
FIG. 17 is a partial cross-sectional side view of the magazine retaining and release system shown in FIG. 16.
Figure 18:
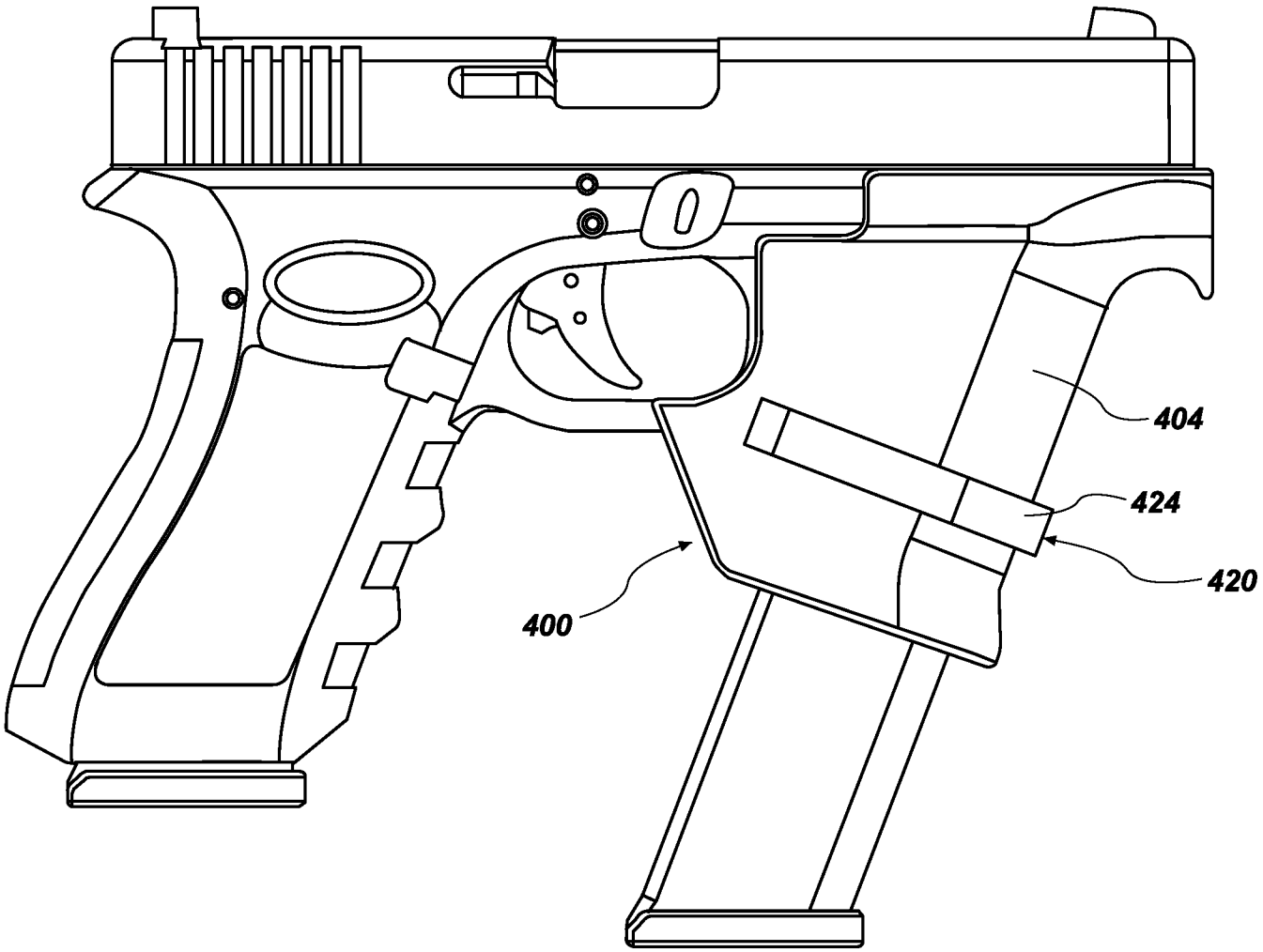
FIG. 18 is another side view of the magazine retaining and release system shown in FIG. 16.

As shown in FIGS. 17 and 18, the magazine release system 400 is configured similarly to the secondary magazine holder 28 shown in FIGS. 1 and 2. The magazine release system 400 includes a release mechanism 420 that is activated by a thumb button 422. Pressing the thumb button, causes the release member 424 to disengage from the spare magazine 410, allowing the spare magazine (see FIG. 18) to drop from the housing 404 by the force of gravity.

Figure 19:
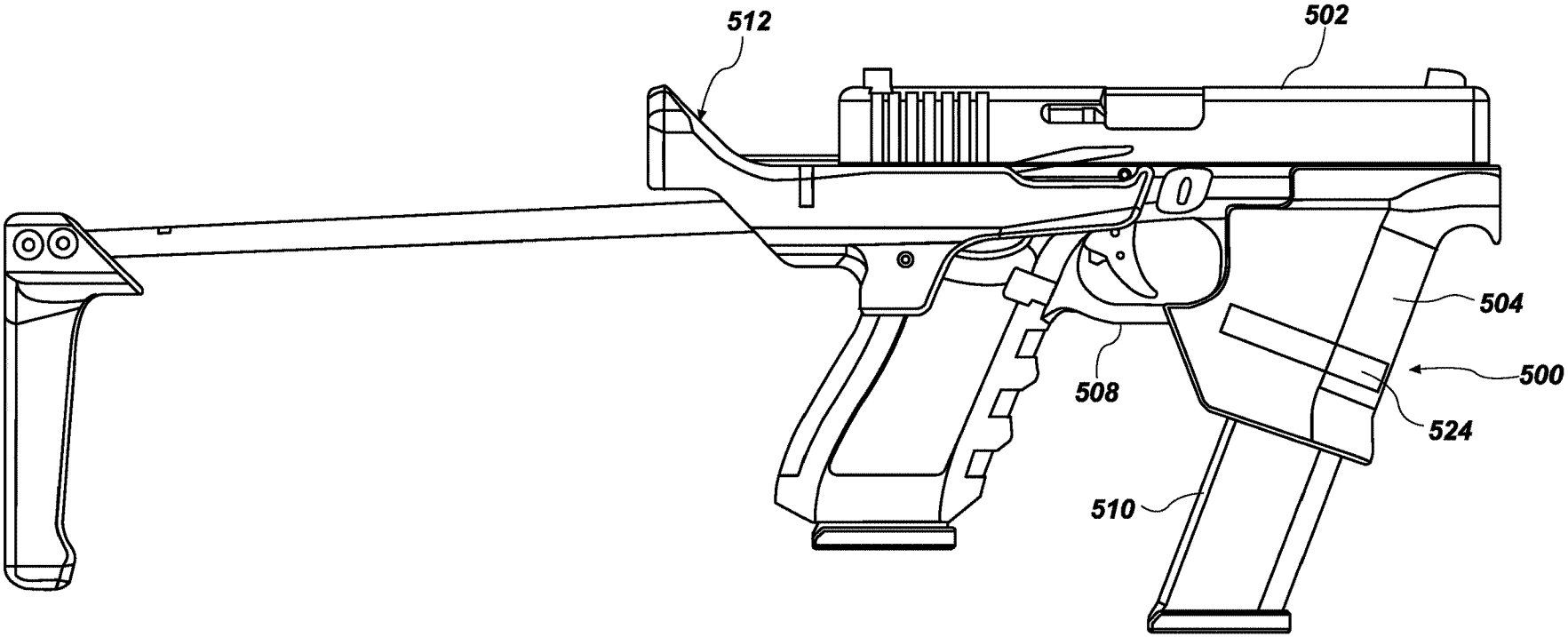
FIG. 19 is a side view of another embodiment of a magazine retaining and release system in accordance with the present invention.

FIG. 19 illustrates another embodiment of a spare magazine release system for attachment to a firearm. The spare magazine release system, generally indicated at 500, is attached to a handgun 502. The magazine release system 500 includes a housing 404 that is configured to be coupled to the handgun 502 and depend downwardly therefrom. The housing 504 is configured to abut against the distal end portion of the trigger guard 508 of the handgun 502 so as to provide additional lateral stability to the housing 504 relative to the handgun 502. The housing 504 is configured to hold and releasably retain a single spare magazine 510. Additionally, as shown, the magazine release system 500 can be used with and/or incorporated into other handgun attachments, such as the deployable arm brace system 512 as shown. The magazine release system 500 is configured similarly to the magazine release system 400 shown in FIGS. 16, 17 and 18. The magazine release system 500 thus includes a release mechanism that is activated by a thumb button. Pressing the thumb button, causes the release member 524 to disengage from the spare magazine 510, allowing the spare magazine (see FIG. 18) to drop from the housing 504 by the force of gravity.

Figure 20:
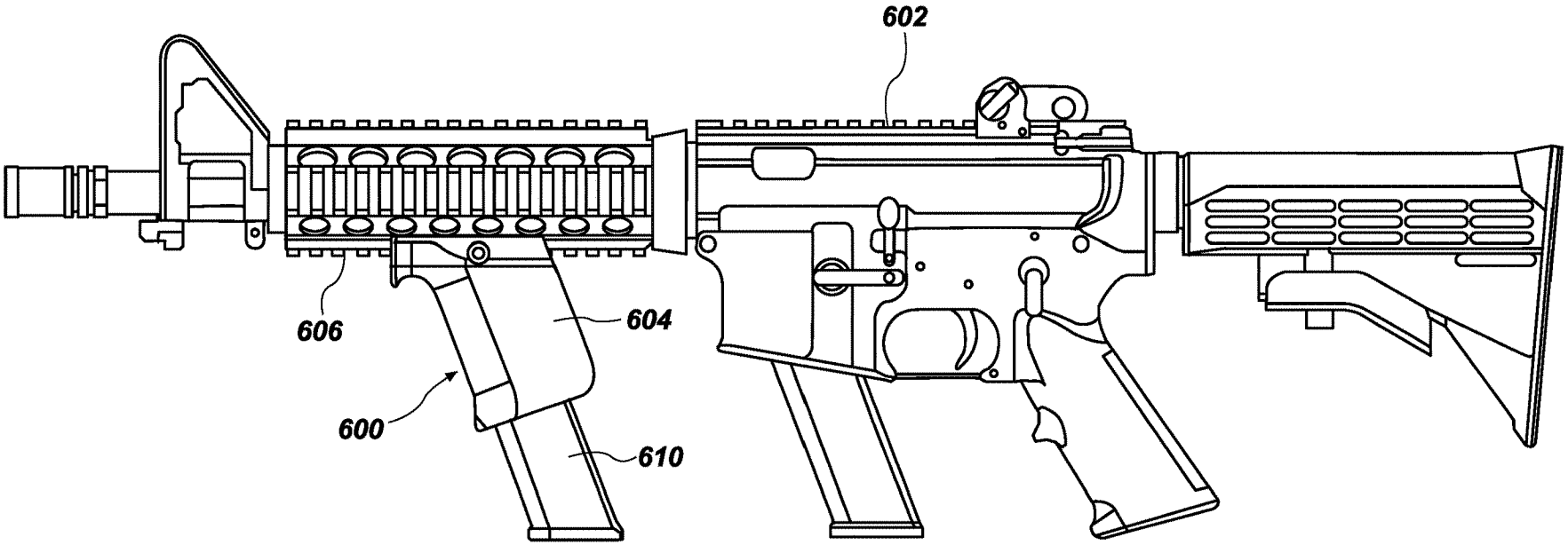
FIG. 20 is a side view of yet another embodiment of a magazine retaining and release system in accordance with the present invention.

As shown in FIG. 20, a release system, generally indicated at 600, of the present invention may be configured to provide a single spare magazine release system for attachment to a rifle 602. The spare magazine release system 600 is attached to the distal end rail system 606 of the rifle 602. The magazine release system 600 includes a housing 604 that is configured to be coupled to the rail system 606 of the rifle 602 and depend downwardly therefrom. The housing 604 is configured to hold and releasably retain a single spare magazine 610. The magazine release system 600 is configured similarly to the magazine release system 400 shown in FIGS. 16, 17 and 18. The magazine release system 500 thus includes a release mechanism that is activated by a thumb button. Pressing the thumb button, causes a release member to disengage from the spare magazine 610, allowing the spare magazine 610 to drop from the housing 604 by the force of gravity.

There is thus disclosed an improved firearm having a firearm magazine release system and method of using the improved firearm magazine release system. In the foregoing specification, the present invention has been described with reference to specific exemplary embodiments. Various modifications and changes may be made, however, without departing from the spirit and scope of the present invention as set forth in the claims, including combinations of elements of the various illustrated embodiments. The specification and figures are illustrative, not restrictive, and modifications are intended to be included within the scope of the present invention. Accordingly, the scope of the present invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The phrase "consisting essentially of" as used herein is intended to cover additional elements or functions that do not materially affect the basic and novel characteristics of the claimed invention. Thus, "consisting essentially of" is intended to encompass not only those components specifically listed, but also separate or additional components that do not materially alter the specifically recited functions or elements. The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus.

In the foregoing description of certain embodiments, specific terminology has been resorted to for the sake of clarity. However, the disclosure is not intended to be limited to the specific terms so selected, and it is to be understood that each specific term includes other technical equivalents, which operate in a similar manner to accomplish a similar technical purpose. Terms such as "left" and right", "front" and "rear", "above" and "below" and the like are used as words of convenience to provide reference points and are not to be construed as limiting terms.

Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same. In addition, the foregoing describes only some embodiments of the inventions, and alterations, modifications, additions and/or changes can be made thereto without departing from the scope and spirit of the disclosed embodiments, the embodiments being illustrative and not restrictive. Furthermore, inventions have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment, and various collections of the described elements may be arranged to consist only of those elements as defined by the claims.

What is claimed is:

1. A dual magazine retaining and release system for a firearm, comprising:

a housing configured to attach to a firearm, the housing including first and second magazine holders, the first magazine holder positioned to retain a first magazine to feed ammunition to the firearm and the second magazine holder positioned in front of a trigger of the firearm and configured to retain a spare second magazine; and a magazine retaining and release system coupled to the housing and configured to retain the first magazine in the first magazine holder and to retain the second magazine in the second magazine holder and to selectively release the first magazine or the second magazine independently from one another or to substantially simultaneously release the first and second magazines from the first and second magazine holders, respectively, upon actuation of the magazine retaining and release system by a user.

2. The system of claim 1, wherein the magazine retaining and release system comprises at least one magazine retaining member movable between a resting position in which the at least one magazine retaining member engages and retains both of the first and second magazines and a second position in which at least one of the first and second magazines is released from its respective first or second magazine holder.

3. The system of claim 1, wherein the magazine retaining and release system further comprises a first release button coupled thereto below and proximate a front side of a trigger guard, the first release button movable between a resting position to a first position in which the first magazine is released and from the first position to a second position in which the second magazine is released.

4. The system of claim 1, wherein the magazine retaining and release system further comprises a second release button coupled thereto and positioned proximate to and above a trigger of the firearm, the first release button movable between a resting position to a first position in which the first magazine is released.

5. The system of claim 1, wherein the magazine retaining and release system further comprises a release tab coupled thereto and positioned proximate to and above a trigger of the firearm, the release tab movable between a resting position to a first position in which the first magazine is released.

6. A firearm, comprising:

a dual magazine retaining and release system, comprising:

a housing configured to attach to a firearm, the housing including first and second magazine holders, the first magazine holder positioned to retain a first magazine to feed ammunition to the firearm and the second magazine holder positioned in front of a trigger of the firearm and configured to retain a spare second magazine; and a magazine retaining and release system coupled to the housing and configured to retain the first magazine in the first magazine holder and to retain the second magazine in the second magazine holder and to selectively release the first magazine or the second magazine independently from one another or to substantially simultaneously release the first and second magazines from the first and second magazine holders, respectively, upon actuation of the magazine retaining and release system by a user.

7. The firearm of claim 6, wherein the magazine retaining and release system comprises at least one magazine retaining member movable between a resting position in which the at least one magazine retaining member engages and retains both of the first and second magazines and a second position in which at least one of the first and second magazines is released from its respective first or second magazine holder.

8. The firearm of claim 6, wherein the magazine retaining and release system further comprises a first release button coupled thereto below and proximate a front side of a trigger guard, the first release button movable between a resting position to a first position in which the first magazine is released and from the first position to a second position in which the second magazine is released.

9. The firearm of claim 6, wherein the magazine retaining and release system further comprises a second release button coupled thereto and positioned proximate to and above a trigger of the firearm, the first release button movable between a resting position to a first position in which the first magazine is released.

10. The firearm of claim 6, wherein the magazine retaining and release system further comprises a release tab coupled thereto and positioned proximate to and above a trigger of the firearm, the release tab movable between a resting position to a first position in which the first magazine is released.

* * * * *